United States Patent [19]

Steere

[11] 4,065,040

[45] Dec. 27, 1977

[54] TENNIS BALL HOLDER

[76] Inventor: Stephen D. Steere, 6364 Trancas Canyon Road, Malibu, Calif. 90265

[21] Appl. No.: 718,577

[22] Filed: Aug. 30, 1976

Related U.S. Application Data

[63] Continuation of Ser. No. 545,873, Jan. 31, 1975, abandoned.

[51] Int. Cl.[2] ..... A45F 5/02

[52] U.S. Cl. ..... 224/5 D; 211/14

[58] Field of Search ..... 224/5 D, 45 L, 5 R, 224/5 A, 5 C, 5 H, 5 J, 3, 13, 28 R, 28 C, 28 D, 26 R, 26 B, 42.46 R, 29B, 37; 248/316 C, 316 R; 211/14, 181

[56] References Cited

U.S. PATENT DOCUMENTS

| | | | |
|---|---|---|---|
| 83,281 | 10/1868 | Harbaugh | 211/14 |
| 939,352 | 11/1909 | Truitt | 211/181 X |
| 2,074,180 | 3/1937 | Hatley | 211/14 X |
| 2,242,833 | 5/1941 | Nibur | 224/29 R |

*Primary Examiner*—Robert J. Spar
*Assistant Examiner*—Jerold M. Forsberg
*Attorney, Agent, or Firm*—Harris, Kern, Wallen & Tinsley

[57] ABSTRACT

A belt-mounted device for holding a tennis ball or the like between two opposing metal loops having laterally extending legs which are joined together through vertical arms spaced apart a distance greater than the diameter of each loop. The junction between each loop and its associated lateral legs provides a flexing joint for the loops which is intermediate the vertical and horizontal extremities of the supporting legs and arms.

5 Claims, 7 Drawing Figures

TENNIS BALL HOLDER

This is a continuation of application Ser. No. 545,873, filed Jan. 31, 1975, now abandoned.

The invention relates generally to ball holding devices, and more specifically to a belt-mounted ball holder for removably securing a tennis ball or the like.

Prior art devices for movably holding a tennis ball or the like on the belt of a player have typically employed complicated unstable wire configurations as shown in U.S. Pat. No. 2,074,180. It is an object of the present invention to simplify and improve such prior art devices and change their configuration in order to provide a more stable, trouble free device with the main flexing or pivot point centrally located relative to the vertical and horizontal extremities of the attached support legs connecting the device to the belt.

Another object of the invention is to provide substantially identical upper and lower wire members which are interchangeable. A related object is to provide a device wherein the ends of such upper and lower members are joined together at a point displaced from the flexing junction adjacent the loops to form a single integral wire loop.

A more specific object is to provide a device where the horizontal distance between the ends of the right and left lateral support legs is greater than the diameter of each of the loops.

A related object is to provide a device of the foregoing characteristic which can be easily mounted on a belt, and which includes restraint means for holding the flexing junctions between the loops and the support legs in close proximity as the loops are spread and expanded from a normally closed position to an open position for receiving the ball.

The foregoing objects, advantages, features and results of the present invention, together with various other objects, advantages, features and results thereof which will be evident to thos skilled in the art to which the invention relates in the light of this disclosure, may be achieved with the exemplary embodiment of the invention illustrated in the accompanying drawing and described in detail hereinafter.

Figure 1:
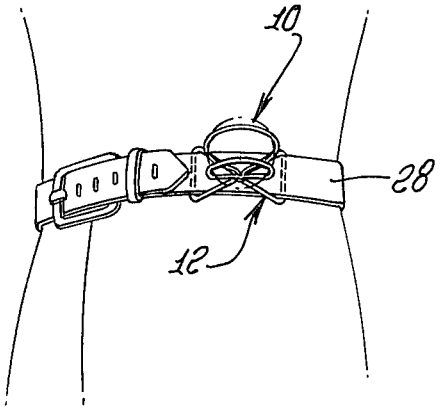
FIG. 1 is a perspective view of a presently preferred embodiment of the invention which is slidably mounted on a belt.

The device includes a top member 10 and a bottom member 12 which are held together at an intermediate point by a suitable restraint such as a ring or washer 14, with the end portions of each member 10, 12 joined together as by a sleeve 16. The structure provides a simple compact device which is easily mounted anywhere on a belt for removably securing a tennis ball or the like, without interfering with the player's activity.

Since the top and bottom members 10, 12 disclosed herein are substantially identical, the description and reference numerals for one as recited below are equally applicable to the other. In this regard, the top member 10 constitutes spring wire having a circular loop 18 centrally located between lateral legs 20 which join the circular loop at a first junction 22. Each lateral leg 20 includes a vertical arm 24 which is joined to the lateral leg at a second junction 26.

Figure 6:
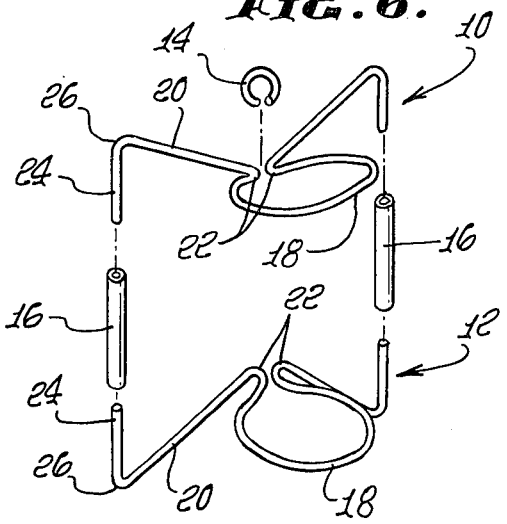
FIG. 6 is an exploded view of the device of FIG. 1.
Figure 2:
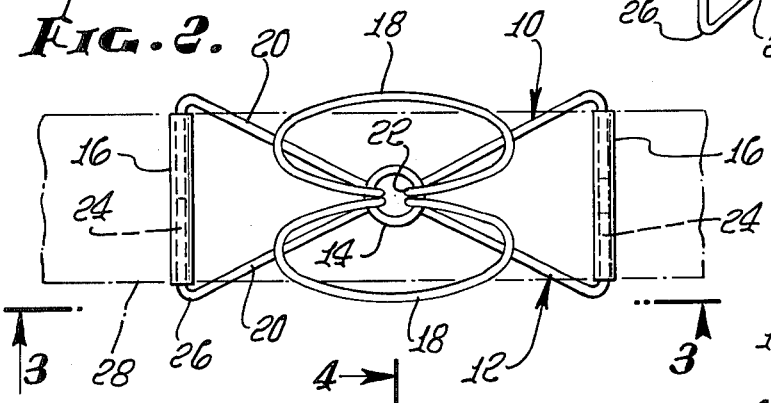
FIG. 2 is a top plan view of the device of FIG. 1.
Figure 4:
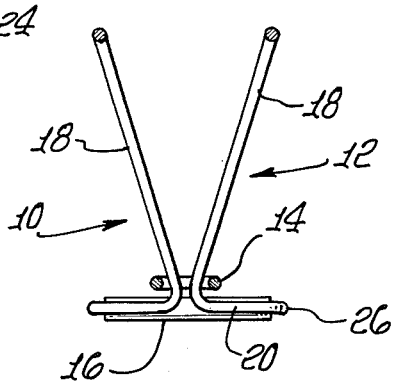
FIG. 4 is a sectional view taken along line 4—4 in FIG. 3.
Figure 3:
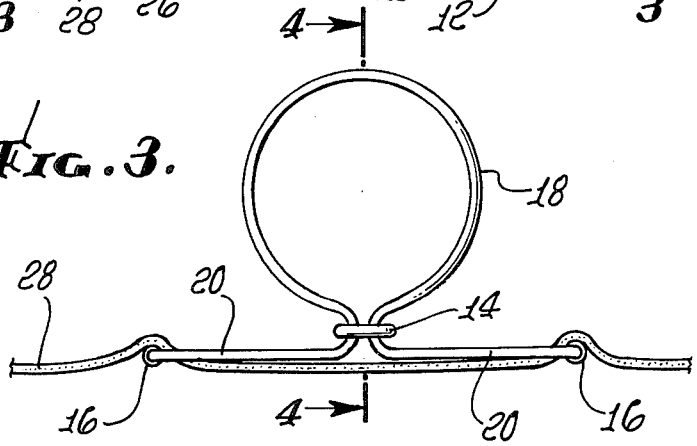
FIG. 3 is a bottom view taken along the line 3—3 in FIG. 2.
Figure 5:
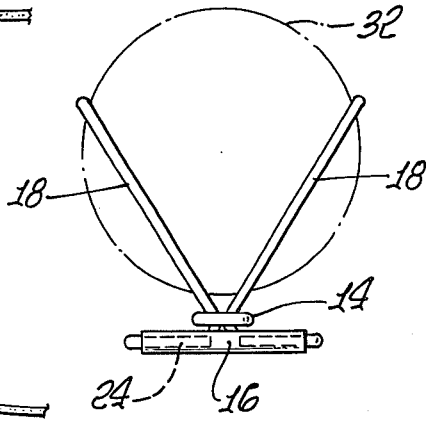
FIG. 5 is a side view showing the device in expanded position to hold a ball.

As best shown in FIG. 6, the top member 10 is positioned with its vertical arms 24 extending downwardly in alignment with similar upwardly extending vertical arms of the bottom member 12 for connection together by the sleeve 16. With the device thus assembled, moving the loops 18 between a closed position (see FIG. 4) and an expanded open position (see FIG. 5) causes flexing at the first junctions 22 while the junctions are held in close proximity by the ring 14. Lateral stability is assured by extending the lateral legs 20 so that the horizontal distance between the second junctions 26 of each member 10, 12 is greater than the diameter of the loops 18. Vertical stability is obtained by having the lateral legs 20 diverge as they extend outwardly from the loops 18, so that the first junctions 22 where pivoting and flexing occurs are located between the upper and lower extremities of the vertical arms 24.

It will be understood that this preferred form of construction connects the two members 10, 12 into a continuous integral wire loop, thus assuring the maintenance of the required spring tension in the loops over long periods of time.

Figure 7:
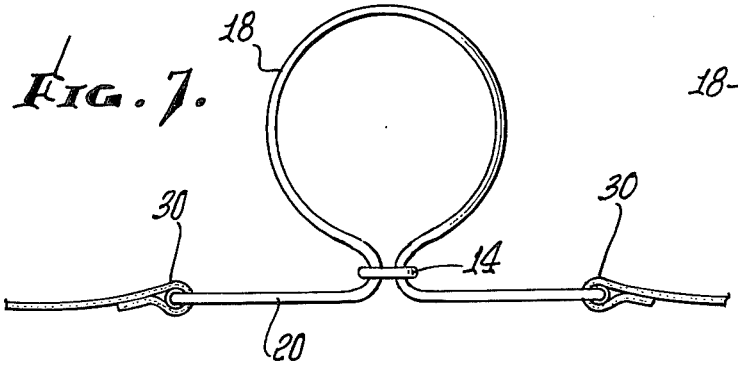
FIG. 7 is a bottom view showing the device of FIG. 1 mounted between the ends of the belt.

The vertical arms 24 and their associated sleeves 16 provide the means for slidably attaching the device to a belt 28, as shown in FIG. 1, or fixedly securing the device between belt ends 30 as shown in FIG. 7.

Although the exemplary ring 14 shown is made of wire, any suitable restraint may be used to hold the pivotal junctions 22 and the adjacent wire portions in position as the two loops 18 are flexed outwardly to receive a ball 32.

To facilitate construction and assembly and to assure optimum operation after both members have been joined together, it was found preferable to have both upper lateral legs connected to and extending from the upper loop, and both lower lateral legs connected to and extending from the downward loop, without any crossing of the wires at the junctions 22. Of course, the invention covers equivalent structure such as connecting both an upper and lower lateral leg to one loop, or changing the loops to an oblique or side-by-side alignment, or providing different configurations of lateral legs, or similar changes which are not shown in the exemplary form shown. However, it is believed that optimum operation and ease of construction occurs in the preferred form shown and described.

In constructing the prototype devices, it was found desirable to add an exterior protection such as a plastic vinyl coating to the entire assembled device to improve the appearance of the end product as well as provide additional strength and protection to assure trouble free operation of the product.

Since the lateral legs 20 are flexible, they can be bent or left flat to conform to the underlying shape of the body. Thus, the positioning shown in FIG. 1 is exemplary only, and the device can be mounted on the belt on the back, side or front of the person wearing it.

Experimental use of the prototype has established its durability under actual playing conditions. Thus, if the loops are spread apart excessively through misuse or accident, the necessary spring tension can be easily restored by pinching the loops together beyond their natural closed position.

Although an exemplary embodiment of the invention has been disclosed for purposes of illustration, it will be understood that various changes, modifications and substitutions may be incorporated in such embodiment without departing from the spirit of the invention as defined by the claims appearing hereinafter.

I claim as my invention:

1. In a belt-mounted tennis ball holder, the combination of:

a. a one-piece upper wire member provided with a central portion formed into a downwardly facing, substantially closed loop having adjacent ends integrally joined to inner ends of laterally extending legs which have downturned outer end portions;

b. a one-piece lower wire member substantially identical to said upper wire member and provided with a central portion formed into an upwardly facing, substantially closed loop having adjacent ends integrally joined to inner ends of laterally extending legs which have upturned outer end portions;

c. first connecting means connecting said downturned outer end portions to said upturned outer end portions, respectively;

d. second connecting means connecting said upper wire member to said lower wire member adjacent the junctions of said ends of said loops with said inner ends of said legs of said upper and lower wire members, said connecting means resisting movement of said loops away from each other; and e. the connections between said downturned outer end portions of said upper wire member and said upturned outer end portions of said lower wire member being spaced apart a distance greater than the diameter of said loops, said spaced outer end portions providing a stable base for said loops.

2. A belt-mounted tennis ball holder as defined in claim 1 wherein said second connecting means includes a ring encircling said loops adjacent the junctions of said ends of said loops with said inner ends of said legs of said upper and lower wire members.

3. A belt-mounted tennis ball holder according to claim 2 wherein said first connecting means includes two sleeves respectively having ends telescoped over said downturned outer end portions and respectively having ends telescoped over said upturned outer end portions.

4. In a belt-mounted tennis ball holder, the combination of:

a. a one-piece upper wire member provided with a central portion formed into a downwardly facing, substantially closed loop having adjacent inner ends integrally joined to inner ends of laterally extending legs which have downturned outer end portions;

b. a one-piece lower wire member substantially identical to said upper wire member and provided with a central portion formed into an upwardly facing, substantially closed loop having adjacent inner ends integrally joined to inner ends of laterally extending legs which have upturned outer end portions;

c. said loops diverging away from each other in a direction extending outwardly away from their said adjacent inner ends;

d. connecting means connecting said downturned outer end portions to said upturned outer end portions, respectively; and e. the connections between said downturned outer end portions of said upper wire member and said upturned outer end portions of said lower wire member being spaced apart a distance greater than the diameter of said loops, said spaced outer end portions providing a stable base for said loops.

5. A belt-mounted tennis ball holder according to claim 4 wherein said connecting means includes two sleeves respectively having ends telescoped over said downturned outer end portions and respectively having ends telescoped over said upturned outer end portions.

* * * * *